US005566809A

United States Patent [19]

Vogt et al.

[11] Patent Number: 5,566,809

[45] Date of Patent: Oct. 22, 1996

[54] VENDING MACHINE PROTECTIVE DEVICE

[75] Inventors: Carl L. Vogt, St. Louis; Ronald E. Lovall, Manchester, both of Mo.

[73] Assignee: Coin Acceptors, Inc., St. Louis, Mo.

[21] Appl. No.: 570,381

[22] Filed: Dec. 11, 1995

Related U.S. Application Data

[63] Continuation of Ser. No. 184,778, Jan. 21, 1994, abandoned, which is a continuation of Ser. No. 893,202, Jun. 2, 1992, abandoned.

[51] Int. Cl.[6] ..... G07F 9/00

[52] U.S. Cl. ..... 194/348

[58] Field of Search ..... 194/344, 347, 194/348, 349, 350

[56] References Cited

U.S. PATENT DOCUMENTS 5,156,250 10/1992 Parish et al. ..... 194/348

5,318,164 6/1994 Barnes et al. ..... 194/348 X

FOREIGN PATENT DOCUMENTS 2-76093 3/1990 Japan ..... 194/348

2-144689 6/1990 Japan ..... 194/348

4-33194 2/1992 Japan ..... 194/348

*Primary Examiner*—F. J. Bartuska

*Attorney, Agent, or Firm*—Cohn, Powell & Hind, P.C.

[57] ABSTRACT

A protective system (10) for use in a vending machine (100) to protect vulnerable parts of the machine, such as the coin changer (130) selection switches, display, harnessing and the like, located below the bill validator (120), from being damaged when liquid is introduced into the bill validator by vandals. The system (10) includes a catch pan (12), attached to the vending machine (100) below the bill validator (120) and providing a reservoir having a bottom (14) and side portions (16, 18, 24 and 26) and a drainage opening (30) and a conduit (34) for carrying the liquid to a remote area.

13 Claims, 1 Drawing Sheet

100
120
122
124
B
126
20
12
2
2
38
18
30
16
14
36
102
32
10
34
130

24
108
100
38
104
20
102
124
120
18
10
14
32
16
12
30
22
110
38
106
26

10
16
22
12
26
30
32
20
14
24

VENDING MACHINE PROTECTIVE DEVICE

This is a continuation of application Ser. No. 08/184,778 filed Jan. 21, 1994 now abandoned which is a CON of 07/893,202 filed Jun. 2, 1992 now abandoned.

BACKGROUND OF THE DISCLOSURE

This invention relates generally to protective devices for vending machines to protect against damage to the vulnerable parts of the machine resulting from liquid introduced into the machine and particularly to the provision of a reservoir installed above the vulnerable parts and a drainage system to direct liquid away from such parts.

The problem of vandalizing vending machines by introducing liquid, particularly salt water, into a machine by way of the coin accepting chute or bill validator entryway is a serious one. Such liquid not only tends to cause the electronic parts of the machine to malfunction short circuiting but also causes corrosion of sensitive parts. Thus, not only can the machine be robbed of its merchandise and cash as a result of precipitated discharge but, in addition, the destruction requires expensive replacement and repair of parts.

Several attempts to solve this problem have been made but the resulting systems tend to be expensive because they involve significant changes to the vending machine. U.S. Pat. No. 4,306,644 discloses a coin chute having means for diverting the liquid by providing vertical, spaced apart rib members providing a drainage grid which intercepts and deflects the liquid while supporting the face of the coins passing over them. Unfortunately, the ribs are space-consuming and represent a major modification. U.S. Pat. No. 4,346,798 discloses a liquid diverting coin hopper employing a somewhat similar principle in that the coin chute includes a perforated support surface receiving the flat surface of the coins but passing liquid into a hopper with a drainage tube. Again, the modifications are substantial and space-consuming. U.S. Pat. No. 5,027,937 discloses a liquid diverting coin chute which replaces the regular coin inlet chute of a vending machine by a housing having a perforated screen wall which divides the coin chute into two passages, one leading to a liquid catchment area and the other to the coin changer. This solution requires the replacement of the vending machine coin chute.

The present invention avoids these disadvantages and provides a solution to the problem of diverting liquid in a manner neither revealed nor suggested in the known prior art.

SUMMARY OF THE INVENTION

This protective device for a vending machine provides a means of avoiding or minimizing damage to vulnerable parts of the machine by containing and diverting liquid introduced into the machine by vandals, without the need to replace or modify existing machine parts.

In a typical vending machine there is a coin changer disposed below the bill validator this device is intended to protect not only the coin changer but also sensitive switching and other vulnerable parts between the bill validator and the coin changer such as selection switches, display and harnessing and the like.

It is an aspect of this invention to provide a vending machine of the type dispensing merchandise for sale and including monetary receiving means at one level and monetary processing means at a lower level, with a means for protecting the machine from damage resulting from liquid introduced into the monetary receiving means, the protective means comprising a reservoir and drainage means attached to the vending machine and disposed between the monetary receiving means and the monetary processing means, and including reservoir means having a bottom portion and wall portions defining an open top sufficiently large to catch liquid introduced into the monetary receiving means, said reservoir means temporarily containing said liquid, and drainage means for directing liquid away from the reservoir means, the size of the reservoir means being sufficient to prevent substantial overflow during drainage of said liquid.

It is another aspect of this invention to provide that the drainage means includes an opening in the reservoir bottom portion and guide means for directing the liquid away from the reservoir means and another aspect to provide that the guide means includes a conduit depending from the bottom opening.

It is still another aspect of this invention to provide that the reservoir means includes front and rear wall portions and opposed end wall portions, said front wall portion being stepped and extending between opposed end wall portions, another aspect to provide that the drainage means is disposed in offset relation between said opposed end wall portion, and still another aspect to provide that the stepped front wall portion includes an upper portion sloped toward the drainage means.

It is an aspect of this invention to provide that said rear wall portion extends on each side of said end wall portions to provide vending machine attachment brackets.

Another aspect of this invention is to provide that the reservoir means extends substantially to the front of the vending machine and still another aspect is to provide that the reservoir means requires only two fasteners for vending machine attachment.

In yet another aspect of this invention the vending machine monetary receiving means is a bill validator and the monetary processing means is a coin changer.

This invention is easy and inexpensive to manufacture, easy to install and is very effective for its intended purpose.

DESCRIPTION OF THE PREFERRED EMBODIMENT

Figure 1:
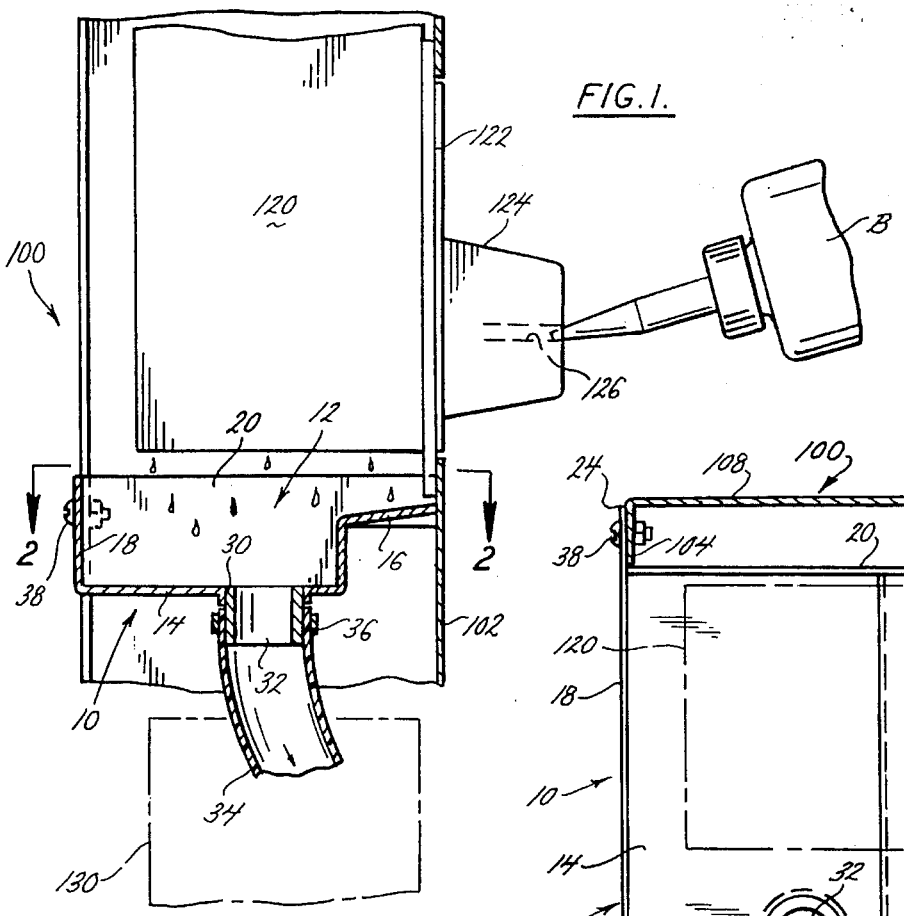
FIG. 1 is a fragmentary elevational view through a vending machine which utilizes the invention.

Referring now by reference numerals to the drawing and first to FIG. 1, it will be understood that the protective device of the present invention, generally indicated by 10, is used in a vending machine 100 to protect the machine against damage from liquid introduced into the machine by vandals.

The vending machine 100 is of the type used for dispensing articles for sale and includes a front plate 102, rear elongate flanges 104 and 106 and opposed sides 108 and 110. The vending machine, in the present embodiment, includes a bill validator 120 mounted to the front plate 102 and constituting a primary stage monetary receiving means. The validator 120 includes a housing 122 having a projecting portion 124 providing an inlet slot 126 for receiving bills to be processed by mechanisms (not shown) within the housing 122, which is generally open at the bottom. The vending machine 100 also includes a coin changer 130, constituting a secondary stage monetary processing means, which is disposed at a lower level, below the bill validator 120, together with other sensitive parts such as the vendor selection switch module, display, harnessing and other vulnerable electronic components (not shown). It will be understood that liquid, for example salt water can be introduced by vandals into the inlet slot as by squirting the liquid from a squeeze bottle B with the intention of causing the vending machine to malfunction and discharge merchandise and/or cash by shorting out or otherwise interfering with the proper operation of the parts. Salt water is a good electrical conductor and, in addition, is very corrosive which can result in severe damage to the coin changer and other parts. This destruction is prevented or at least minimized by providing a protective device or shield between the bill validator 120 and the coin changer 130. In the embodiment shown, the protective device is provided by a liquid containment and directing assembly 10 disposed between the bill validator 120 and coin changer 130.

The liquid containment and directing assembly 10 includes a catch pan 12 providing a reservoir having bottom portion and peripheral wall portions defining an open top sufficiently large to collect liquid issuing from the bottom of the bill validator 120. In the embodiment shown the catch pan 12 is formed from metal, plastic, or the like, to provide a bottom portion 14, an ell-shaped front wall portion 16, a rear portion 18 having overhanging ends 24 and 26 and end wall portions 20 and 22. The bottom portion 14 is generally horizontal and includes a bottom opening 30, which is provided with a spout 32 and constitutes a drainage means. The upper leg of the ell-shaped front wall portion is sloped to lead into the primary catchment area provided by the lower portion of the catch pan 12 and away from the vending machine front plate 102. The catch pan 12 in the preferred embodiment is formed from a single metal sheet but it could also be formed from several connected parts or molded from plastic.

The catch pan 12 is attached by the overhanging ends 24 and 26 which provide brackets for attaching the pan to the vending machine flanges 104 and 106, respectively, as by fasteners 38. In the preferred embodiment the meeting edges of the end wall portions are brazed, or soldered, to the front and rear wall portions of the pan as necessary to provide a watertight catch pan 12 and increase the stiffness of the overall pan structure. The drain spout 32 provides a fitting for a conduit 34, attached as by a clamp 36, which provides a guide means directing liquid away from the vulnerable parts of the vending machine below the catch pan 12.

Figure 2:
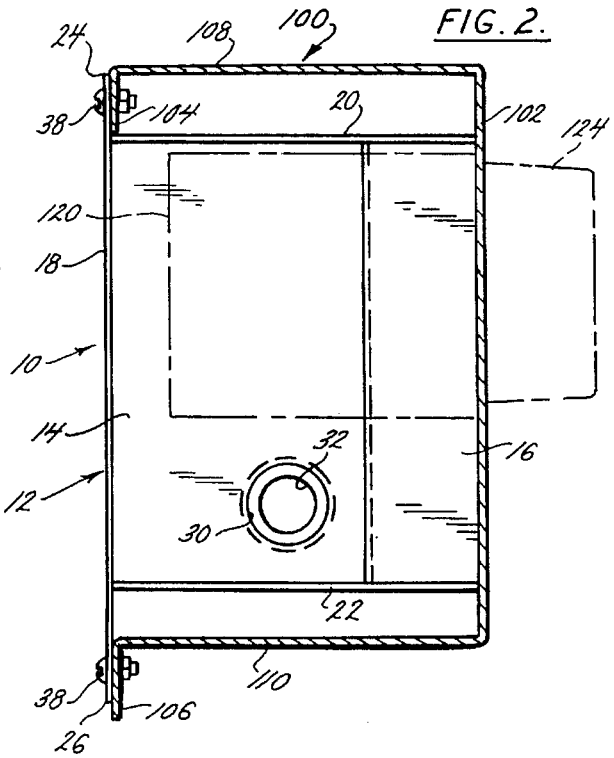
FIG. 2 is a cross sectional view taken on line 2—2 of FIG. 1.
Figure 3:
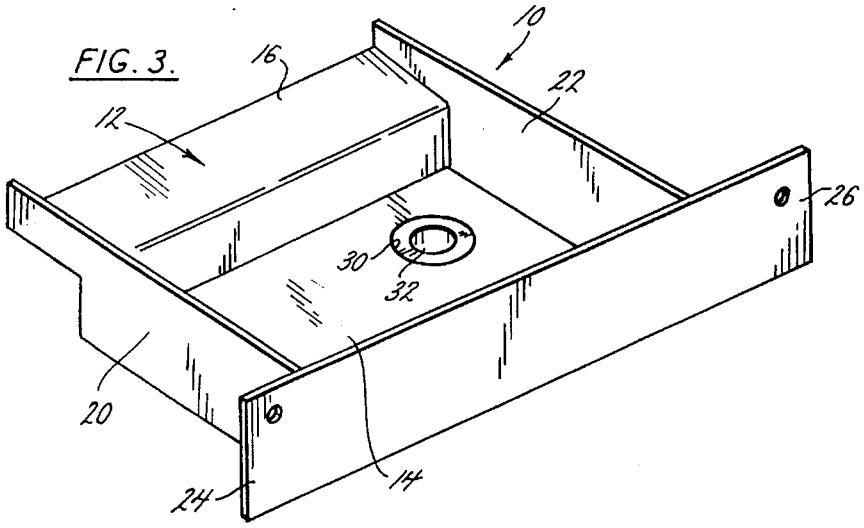
FIG. 3 is a perspective view of the catch pan.

The installation and operation of the system are simple and effective. The catch pan 12 is installed by inserting it into the vending machine 100 below the bill validator 120. The size of the device is chosen such that when the overhanging ends 24 and 26 are attached by fasteners 38 to the vending machine flanges such that the front of the device is in close proximity to, or engages, the front wall of the vending machine. Only two, easily accessible, fasteners are required. As shown in FIG. 2 the width of the catch pan 12 is at least as great as the width of the bill validator. With this structural arrangement of parts, and with a properly chosen depth of catch pan 12, the catch pan has a volume sufficient to accommodate the flow of liquid during drainage so that the flow resulting from the introduction of liquid by a vandal from the squeeze bottle B and passage through the bill validator 120 is contained and drained and the vulnerable vending machine parts below the catch pan are protected.

Although the protective device has been described by making particular reference to a preferred catch pan and drainage system, the details of description are not to be understood as restrictive, numerous variants being possible within the principles disclosed and within the fair scope of the claims hereunto appended.

We claim as our invention:

1. In a vending machine of the type dispensing merchandise for sale and including a bill validator, and a means for protecting the machine from damage resulting from liquid introduced into the bill validator:

(a) a bill validator having a bottom from which liquid issues, and (b) a mechanical, non-electronic catch pan, disposed below the bill validator and having a bottom portion and wall portions defining an open top substantially as large as said bill validator bottom to catch liquid introduced into and exiting from the bill validator said catch pan temporarily containing said liquid, and drainage means for directing liquid away from the catch pan, the catchment area and depth of the catch pan and the drainage means being sufficient to prevent substantial overflow during drainage of said liquid.

2. A vending machine as defined in claim 1, in which:

(c) the drainage means includes an opening in the catch pan bottom portion and guide means for directing the liquid away from the catch pan.

3. A vending machine as defined in claim 2, in which:

(d) the guide means includes a conduit depending from the bottom opening.

4. A vending machine as defined in claim 1, in which:

(c) the catch pan includes front and rear wall portions and opposed end wall portions, said front wall portion being stepped and extending between opposed end wall portions.

5. A vending machine as defined in claim 1, in which:

(c) the catch pan includes front and rear wall portions and opposed end wall portions, and the drainage means is disposed in offset relation between said opposed end wall portions.

6. A vending machine as defined in claim 4, in which:

(c) said catch pan stepped front wall portion includes an upper portion sloped toward said drainage means.

7. A vending machine as defined in claim 1, in which:

(c) said rear wall portion extends on each side of said end wall portions to provide vending machine attachment brackets.

8. A vending machine as defined in claim 7, in which:

(d) the catch pan extends substantially to the front of the vending machine.

9. A vending machine as defined in claim 7, in which:

(d) the catch pan requires only two fasteners for vending machine attachment.

10. In a vending machine of the type dispensing merchandise for sale and including a bill validator, and a means for protecting the machine from damage resulting from liquid introduced into the bill validator:

(a) a bill validator having a bottom from which liquid issues, and (b) a mechanical, non-electronic catch pan disposed below the bill validator to catch liquid introduced into and exiting from the bill validator and a drainage conduit to direct liquid away from the catch pan, the catch pan having a width at least as great as the width of the bill validator to define an open top substantially as large as the bill validator bottom to collect liquid issuing from the bottom of the bill validator and a depth to provide a catch pan volume sufficient to accommodate the flow of liquid during drainage, the drainage conduit being sufficiently large to substantially prevent overflow during drainage.

11. In a vending machine of the type dispensing merchandise for sale and including a bill validator, and a means for protecting the machine from damage resulting from liquid introduced into the bill validator:

(a) a bill validator having a bottom from which liquid issues, and (b) a mechanical, non-electronic catch pan including attachment means holding the catch pan directly under the bill validator, the catch pan including a bottom portion having a drainage outlet and wall portions providing the catch pan with a catchment area substantially as large as the bill validator bottom to collect liquid issuing from said bill validator and a depth to provide the catch pan with a volume sufficiently great to substantially contain the liquid during drainage from the drainage outlet and substantially prevent overflow.

12. A vending machine as defined in claim 11, in which:

(c) the catch pan is located to substantially intercept the liquid flow from the bill validator into any coin path between the bill validator and a coin changer.

13. A vending machine as defined in claim 11, in which:

(c) the drainage outlet includes a drain spout offset with respect to the bottom portion of the catch pan to facilitate diverting liquid from the coin changer.

* * * * *